US007306184B2

(12) United States Patent
Tafel

(10) Patent No.: US 7,306,184 B2
(45) Date of Patent: Dec. 11, 2007

(54) SPLICING VEHICLE

(76) Inventor: Brian L. Tafel, 1821 Azalea La., Mount Prospect, IL (US) 60056

( * ) Notice: Subject to any disclaimer, the term of this patent is extended or adjusted under 35 U.S.C. 154(b) by 0 days.

(21) Appl. No.: 10/662,686

(22) Filed: Sep. 15, 2003

(65) Prior Publication Data

US 2005/0056719 A1 Mar. 17, 2005

(51) Int. Cl.
*B65H 19/18* (2006.01)

(52) U.S. Cl. ..... 242/555.3; 242/554.6; 242/557

(58) Field of Classification Search ..... 242/555.3, 242/555.4, 557, 559.4, 554, 554.2, 554.6
See application file for complete search history.

(56) References Cited

U.S. PATENT DOCUMENTS 3,740,296 A 6/1973 McDonald
3,831,876 A 8/1974 Phelps
4,132,371 A * 1/1979 Byrt ..... 242/555.4
4,729,522 A 3/1988 Tafel
6,451,145 B1 * 9/2002 Forbes ..... 242/555.4

* cited by examiner

*Primary Examiner*—William A Rivera

(57) ABSTRACT

A roll transport and splicing vehicle is disclosed which is adapted to splice a new roll onto an expiring roll supported in an unwind station. The vehicle lifts and transports new rolls of material prepared with an adhesive splice pattern in the conventional manner of flying splices. The vehicle then carries the roll into an exact position next to an unwind stand and this roll is then automatically spliced into the expiring web in the unwind stand. The expired roll is severed from the web, and its coreshaft or corechucks are moved from the unwind stand to a position over the new roll, and the new roll is moved into the position formerly occupied by the expired roll. The vehicle then moves from the unwind stand, conveying the expired roll assembly to a roll storage location from which another new roll may be retrieved.

12 Claims, 9 Drawing Sheets

SPLICING VEHICLE

SUMMARY OF THE INVENTION

The present invention is small and portable, requiring little or no change to the press arrangement, only a speed sensor and dispensing roll diameter sensor on the web utilizing device, and locating disks in the floor. The apparatus may be computer controlled to automatically retrieve and move a new roll into a position next to the dispensing roll, to then splice the new roll with the exiting web from the dispensing roll, and to replace the depleted dispensing roll with a new dispensing roll, without interrupting the web supply. Of particular advantage is the ability of this portable splicer to consecutively service unwind devices on a variety of web utilizing devices. Optional provision is made to retain the rotational direction of the actively unwinding roll before and after splicing, a common requirement when using paper having different finishes on each side.

BACKGROUND OF THE INVENTION

The present invention relates to web splicers which form an automatic flying splice between a new roll and a web of material running from an expiring roll. More particularly, it is directed to a vehicular transporting and splicing apparatus for rolls of web material wherein a single apparatus may service several unwinding devices. The primary use for the present invention is likely to be printing and converting paper and plastic film, although other materials and uses may be handled using the present technology.

The present manual unwind stand operations on smaller web presses without splicers proceed as follows: when an unwinding roll is essentially depleted, the printing press is stopped, and the web connected to the web-consuming machine is manually severed from the remainder of the roll. The roll and coreshaft assembly is then manually lifted from the unwind stand. A new roll on a dolly is then moved next to the unwind stand and levered up into the unwind position, where it is then hand spliced onto the severed end of the web. The press is restarted and after several minutes of continuously producing waste, production resumes.

These manual operations are time-consuming, wasteful, arduous and injury-prone.

To avoid downtime of the web-consuming machine, two main concepts have been used to design a splicer to connect a new roll to the running web, especially on printing presses. Some use a festoon to store a sufficient length of web to allow a stationary splice to be made, while the depleting festoon continues to supply a moving web.

Other types of splicers, referred to as flying splicers or speed match splicers, make a splice automatically at operating speed by matching the surface velocity of the new roll to that of the expiring web, and rapidly adhering the end of the outer wrap of the new roll onto the expiring web. Most speed match splicers utilize a surface drive on the new roll. This requires that one or two areas across the width of the web be free of adhesive, which allows the high-velocity air used in most dryers to enter this slot in the splice, inflating it and often causing a web-break. Examples of prior art are:

McDonald U.S. Pat. No. 3,740,296, teaches the use of pivoted arms to support rolls.

Phelps U.S. Pat. No. 3,831,876, teaches a core chuck driven roll, and describes the splicing mechanism and ability to splice either the inside or outside of the paper facing upward.

Tafel U.S. Pat. No. 4,729,522, uses a surface belt drive with the disadvantage mentioned above, of not having a continuous adhesive pattern across the face of the new roll.

To overcome on this particular objection, the present invention drives the roll by its coreshaft. An example of this general type of splicer is taught in Martin U.S. Pat. No. 5,335,870 which is especially useful for printing presses having only one or two webs, or which are fed at right angles to the pressrow by web turning bars.

Both types of splicing machines are quite large, occupying a volume many times that of the rolls they process. When used with printing presses and converting lines, it is often necessary to reconfigure the entire operation to provide sufficient additional space for these splicers and space to load them. Further, there is considerable expense involved, as one splicer must be provided for every web, and in newspaper applications, multiple webs are customary. Another means of solving the floor space problem has been to stack splicers on top of one another, but this requires operators to climb ladders and work off of platforms, hoisting devices on rails, and all the webs must be strung down to floor level and under the presses.

BRIEF DESCRIPTION OF THE DRAWINGS

Reference is made in the foregoing description to paper and printing, but the same concepts and apparatus may be applied to many different web consuming operations. In the detailed description of the invention which follows, reference will be made to the accompanying drawings composed of the following figures.

DETAILED DESCRIPTION OF THE PREFERRED EMBODIMENT

Figure 1:
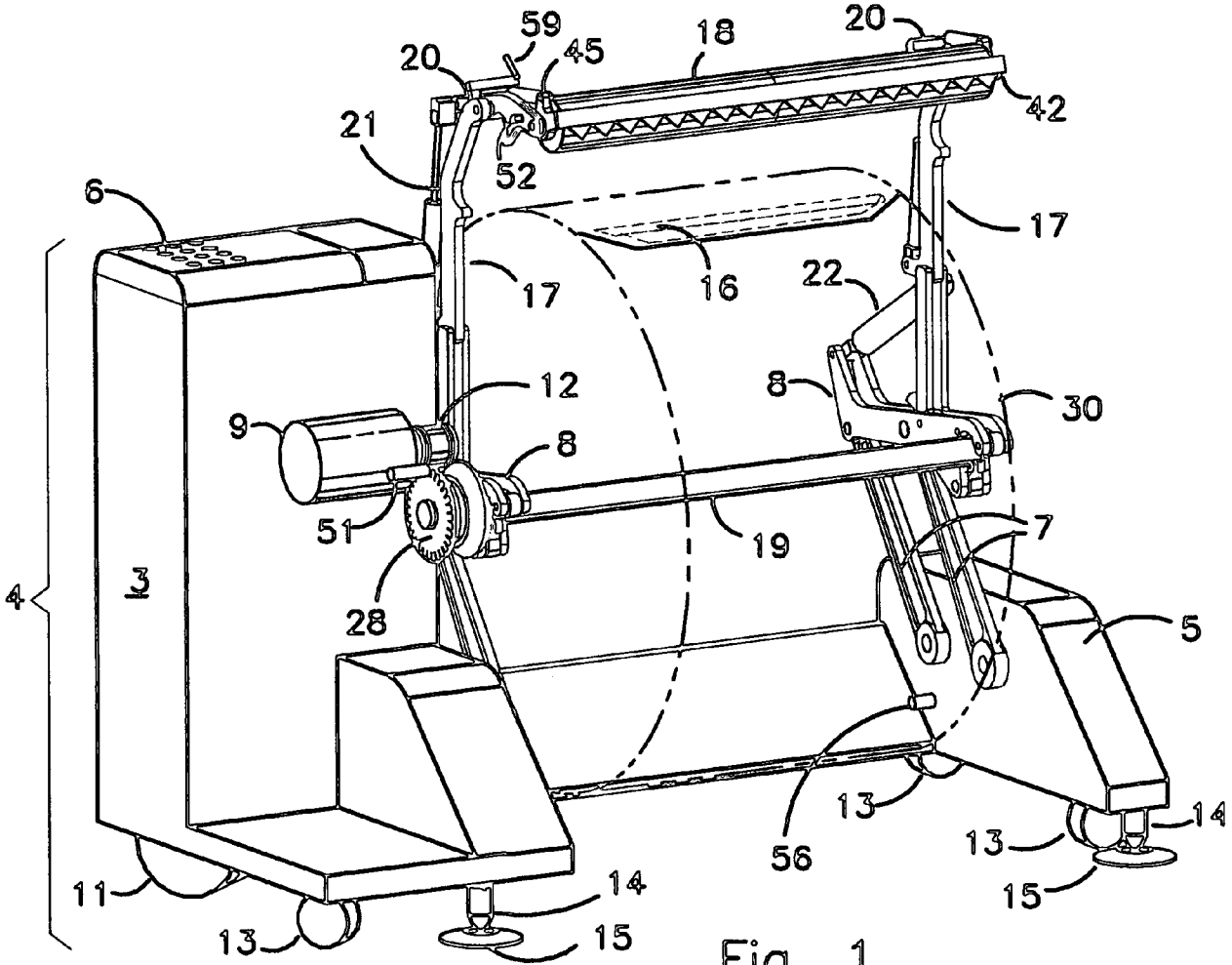
FIG. 1 is a pictorial view of the splicer vehicle in its preferred embodiment, showing the splicer vehicle conveying an expired roll. The splicehead arms are raised.

The present invention relates to apparatus to form a flying splice wherein new-rolls of material are supported within a vehicle equipped with a lifting mechanism to lift and position new-rolls, and incorporating a splicing mechanism to splice the outer wrap of material onto expiring rolls in at least one unwind stand. Optional provision is made to retain the rotational direction of the actively unwinding roll before and after splicing, an advantage when using paper having different finishes on each side.

Although the following terminology refers primarily to printing and paper, it must be understood the present invention is applicable to any of a variety of web-consuming devices or materials.

The sequence of operation for the present invention as it applies to paper and plastic film is generally as follows:

In a web printing or converting production line, a web utilizing device is provided with a web from a splicer, or from an unwind stand. In the case of an unwind stand, the present invention provides a means to automatically splice a new roll onto the dispensing roll in the unwind stand, thereby supplying a continuous, uninterrupted web supply to the web utilizing device without the expense of having a splicer for each web.

When it is determined, either visually, or by automatic sensing devices, that the roll dispensing a web is substantially depleted, the present invention provides a vehicular splicer to retrieve a new roll from a storage area and to splice a web from that roll onto the web of the roll being dispensed. The new roll must first be unwrapped and a coreshaft inserted and locked into the hollow core of the new roll, and this assembly is hereinafter referred to as the "second roll assembly". A pair of parallel roll lifting arms then extend from the splicing vehicle and engage each end of the coreshaft and lift the second roll assembly off the floor and into the interior of the vehicle for transport to a predetermined location next to the roll unwind. Pins are then lowered from the splicing vehicle into sockets in the floor, accurately locating the vehicle.

When the dispensing roll is depleted sufficiently to allow a splice, the roll lifting arms extend to move the new roll from the vehicle until the circumferences of the new roll and the dispensing roll are less than approximately two inches apart and parallel. The splicehead arms then lower the splicing mechanism down over the coreshaft of the dispensing roll. The new roll is then rotated to a surface velocity approximating the velocity of the dispensing web, at which time the splicing roller brackets are pivoted to redirect the dispensing web out of the roll unwind device and against an adhesive area on the outer wrap of the new roll, thereby effecting a splice.

A severing knife then detaches the splice from the expired roll. The new-roll drive motor goes into a braking mode responsive to a web tension indicated by a web-tension sensor preferably mounted in the unwind stand, and maintains web tension at a operator established set-point until the roll is moved into position in the unwind web-stand, at which time tensioning is provided by the braking means normally provided by the unwind stand. The expired roll is then removed from the press, the roll support arms are retracted, and the vehicle is moved away from the press, supported on its wheels. The arms are then lowered to a convenient height and the coreshaft removed from the splicehead arms for recycling into a new roll.

Referring now to pictorial view FIG. 1 of the splicer vehicle in its preferred embodiment, showing the splicer vehicle 4 conveying a new roll 30 which is loaded into the roll lifting arms 8. The splicehead arms 17 are raised by linear actuator 22. The splicer vehicle consists of an operator-side housing 3 with operator control panel and attached computer 6, and a drive-side housing 5, all supported on castered wheels 13 and driven wheel 11. Protruding from the underside are aligning pins 14 and 15 which are lowered into alignment disks 15 having elongated slots which are affixed to the pressroom floor immediately adjacent to the web-consuming device to provide accurate positioning of the splicer vehicle with respect to that device. Sensor 56 limits the positioning of the new roll during loading and thereby indicates the new roll diameter by referencing the position of arms 7.

Figure 2:
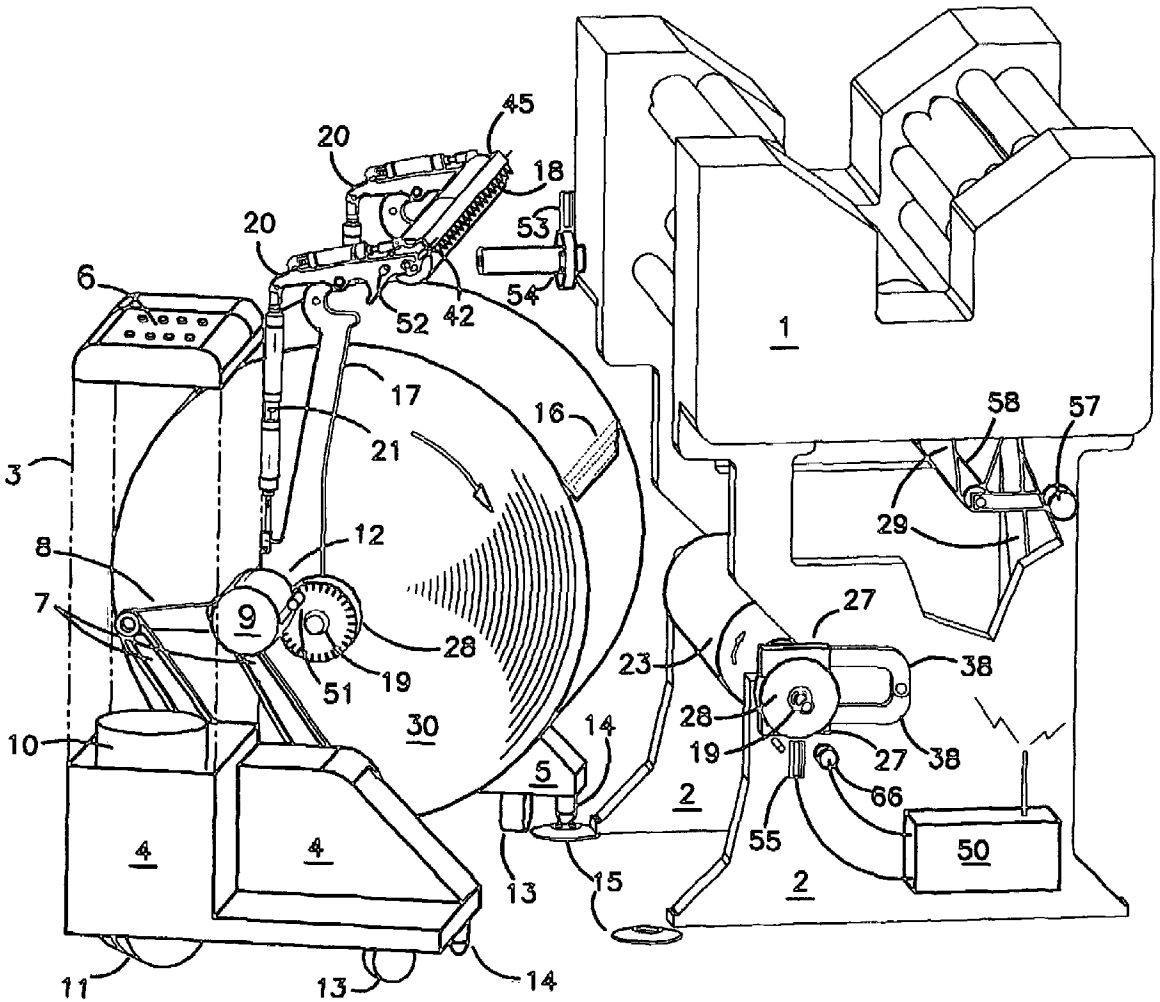
FIG. 2 is a pictorial view of the splicer vehicle in its preferred embodiment, conveying a roll into position adjacent to an unwind located under a small printing press.

Referring now to pictorial view FIG. 2, the preferred embodiment is shown moving into a splicing position adjacent to a small web press 1 of common design having an unwind stand 2 beneath it which rotationally supports dispensing roll 23 having coreshaft 19 with brake drum 28 rigidly affixed thereto, hereinafter referred to as the "first roll assembly" so disposed that the brake regulates the web tension in the conventional manner of a rollstand by referencing a dancer-roll 58 with position sensor 57. New roll 30 is shown mounted into the splicing vehicle with a splice pattern 16 already prepared. Signals between the vehicular splicer and web consuming device are transmitted between a transceiver in the vehicular splicer control-panel-computer assembly 6 and a transceiver 50 on the web-consuming device. Sensor 51 indicates the RPM of the new roll and sensor 52 indicates the RPM of splicing roller and thus the web speed. Sensor 53 indicates RPM of the driveshaft 54 of the web-consuming device 1. Sensor 55 located on the vehicular splicer indicates the RPM of the new roll assembly.

Figure 3:
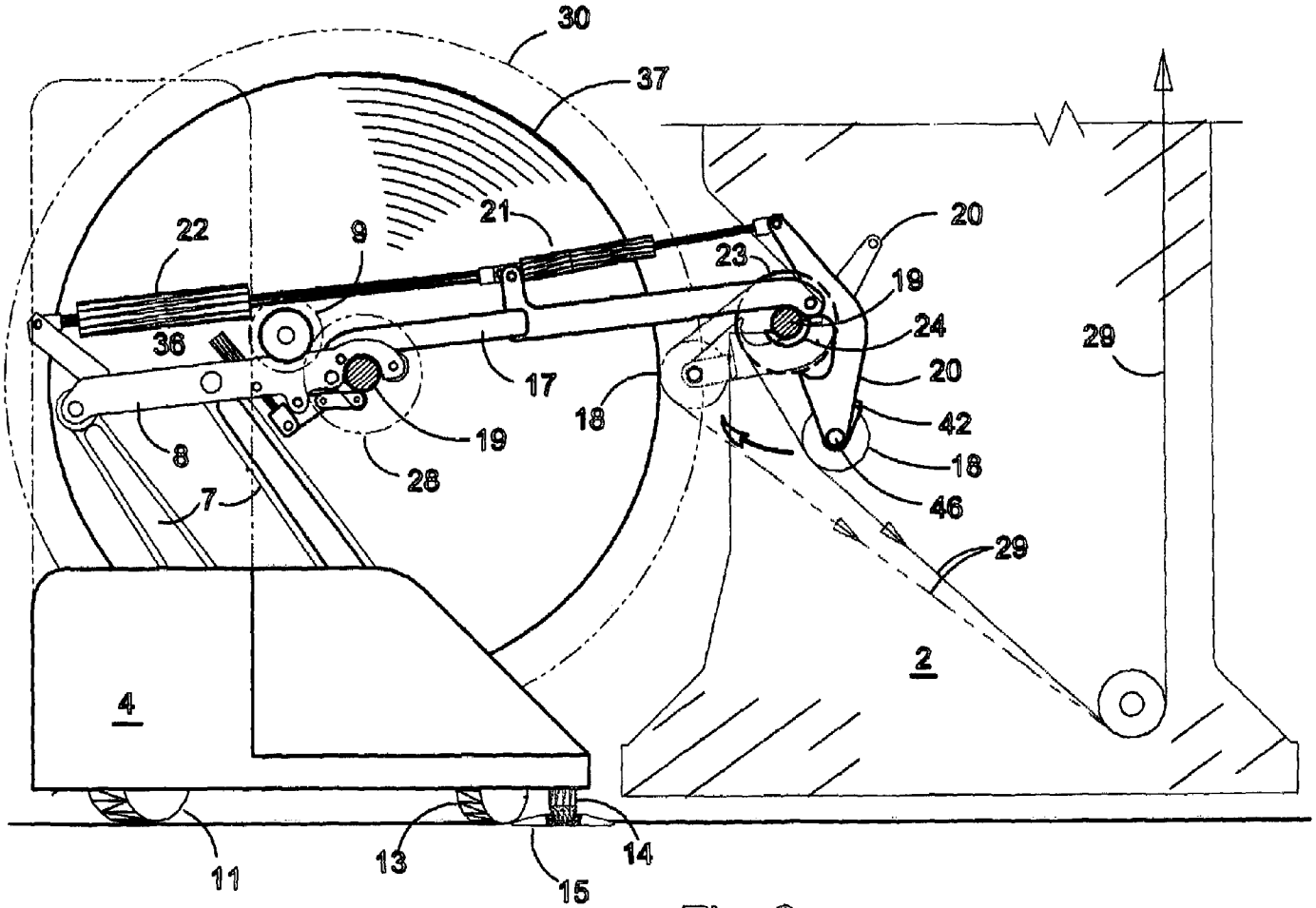
FIG. 3 is a front view of the splicer vehicle at the beginning of a splice cycle, showing the web from a dispensing roll being spliced onto a new roll.

FIG. 3 is a front view at the beginning a splice cycle. New roll 37 illustrates the smallest new roll that may be accommodated, and new roll 30, shown in phantom lines, illustrates the largest roll that may be accommodated. The roll-lifting arms 8 with their roll retaining latches activated by actuators 36, have been moved into the splice position by the rotation of pivoting arms 7. The splicehead-arms 17, each raised and lowered by contraction and extension of linear actuator 22, and each having a splice roll bracket 20 operated by actuator 21, act in combination to support splicehead shaft 46 at each of its ends, including the resilient splicing roller 18 and severing knife 42 supported thereby. The splice roll bracket 20 is shown (in bold lines) as the splicing roller first contacts dispensing web 29 and also in a second position, in phantom lines, after it has rotated approximately 90 degrees of revolution to press the dispensing web against the adhesive area on the new roll 37, thereby effecting a splice between the web from the dispensing roll and the outer wrap of the new roll. Operative rotation of severing knife 42 by shaft 46 then detaches the web from the dispensing roll in the unwinding stand to complete the splice cycle, whereupon the splicehead arms and splice roll bracket 20 acting in combination with the splicing roll 18, grasp and remove this roll from rollstand support bearing saddles 24 to the location shown over the top of the vehicle. The splicing vehicle is then 10 moved to a location where the arms can be lowered and the coreshaft removed.

Figure 4:
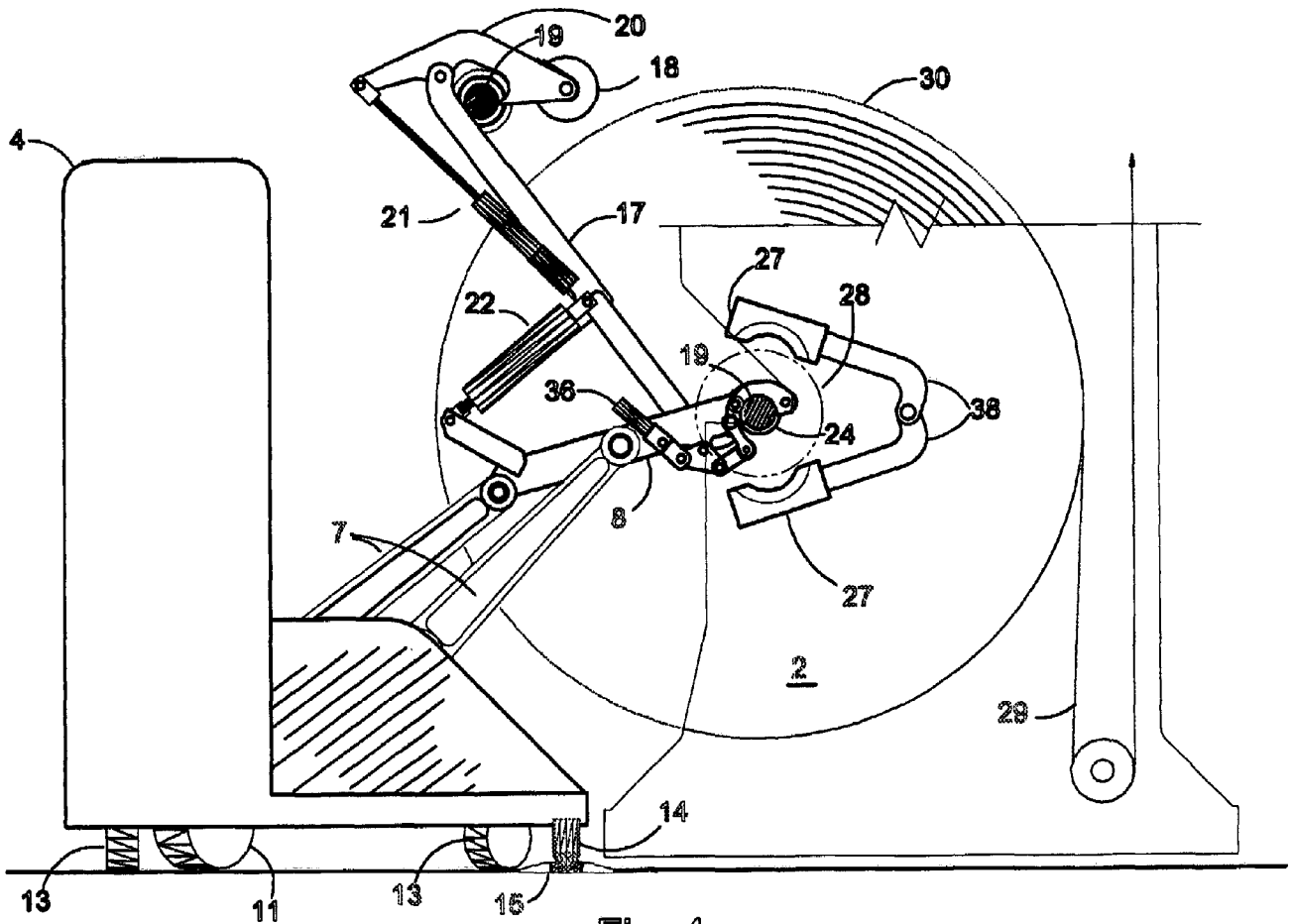
FIG. 4 is a front view of the splicer vehicle in its preferred embodiment, showing its roll lifting arms having moved the newly-spliced roll into dispensing position after having lifted the expired roll up out of the way.
Figure 5:
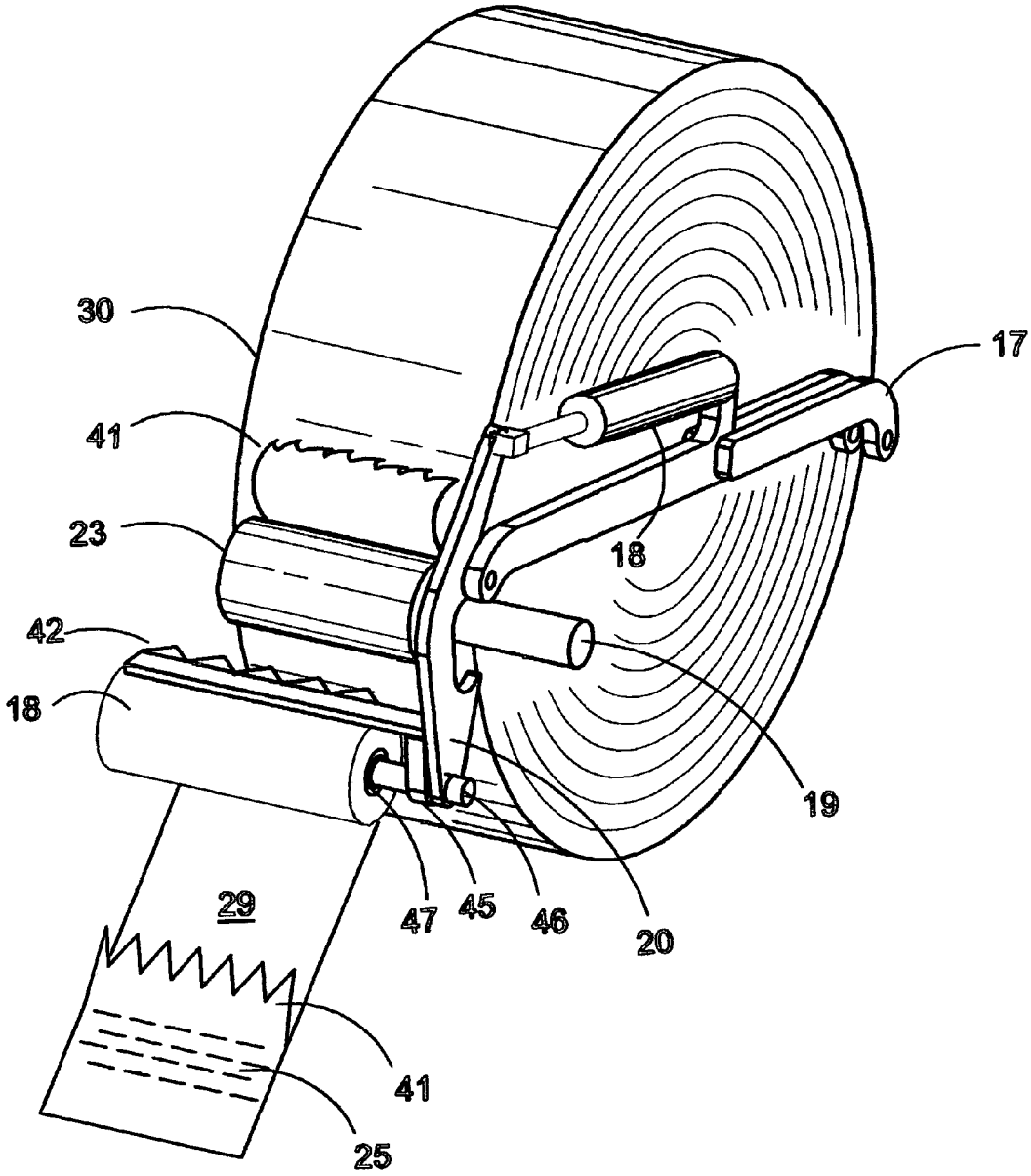
FIG. 5 is a detailed pictorial view of the new roll, the web-repositioning idler-roller, severing knife, and splicehead positioning arm, immediately after a splice. The view is shown truncated at the centerline

Referring now to front view FIG. 4, the pivoting arms 7 and lifting arms 8, move in unison to place the new roll coreshaft 19 and new roll 30 into bearing saddles 24. Acting in unison, brake arms 38 then operatively rotate together and cause the brake pads 27 supported thereby, to grasp brake drum 28 and thereby restrain its rotation, and causing tension to be maintained in the dispensing web 29.

Pictorial view FIG. 4 shown truncated at the centerline of apparatus, illustrates the splicing elements in enlarged detail, immediately after splice 25 joined the end of web 41 from expired roll 18, to exiting web 29 from the new roll 30. Splicing roller brackets 20 are preferably pivotably supported by splicehead arm 17, and are caused to pivot by splicing roll linear actuator 21. Shaft 46 rotatably supports roller 18 by bearings 47 on which are also positioned splicing roller brackets 20. Knife 42 is affixed to clamping blocks 45, which rigidly clamp onto operatively rotatable shaft 46. Upon operative rotation of said shaft, the dispensing web is severed. The hooked shape of bracket 20 aids in confining and subsequently grasping the coreshaft 19.

Figure 6:
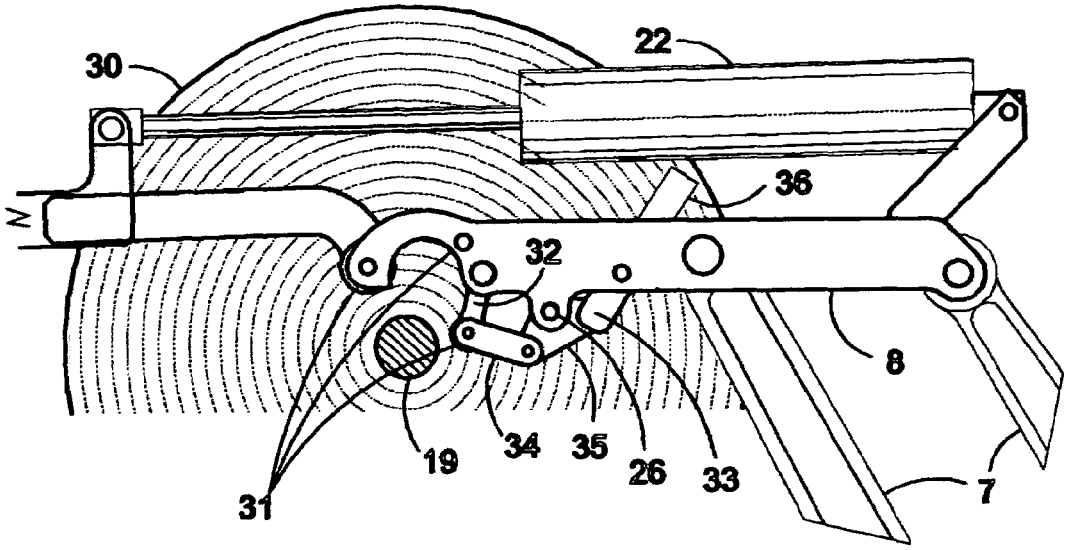
FIG. 6 is a pictorial view showing the roll lifting assembly about to move down and engage the coreshaft of a new replacement roll.

FIG. 6 is a pictorial view showing the roll lifting assembly just prior to moving down and engaging the coreshaft 19 of a new replacement roll 30. Actuator 36 has retracted, which rotates triangular block 35 Counterclockwise about pin 26. Toggle link 34 which is rotatably attached to the triangular block, pulls on roller link 32, causing it to rotate into an open position to accept the coreshaft 19.

Figure 7:
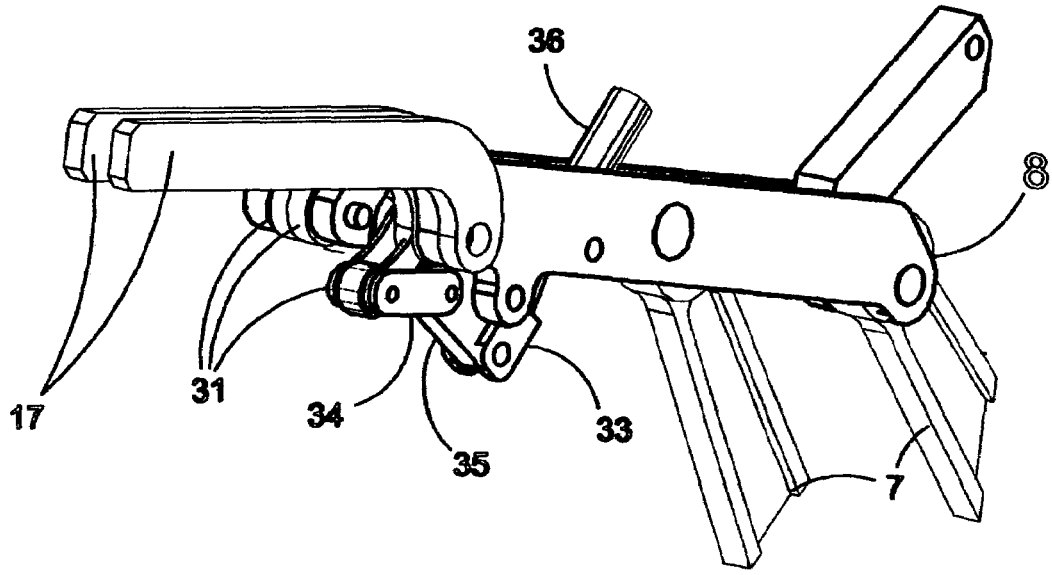
FIG. 7 is an pictorial view of the roll lifting assembly and engaging mechanism in its locked position.

FIG. 7 is an pictorial view of the roll lifting assembly in the clamped condition. The coreshaft is omitted for clarity. Actuator 36 has extended, rotating triangular block 35 clockwise about pin 26. Toggle link 34 which is rotatably attached to the triangular block, pushes on roller link 32 and toggles over-center, causing the roller link to rotate into a closed position to grasp the coreshaft 19, and to remain locked in that position in the event the energy source to the actuator is accidentally interrupted. The coreshaft is supported between rollers 31, which are arrayed in a triangle.

Figure 8:
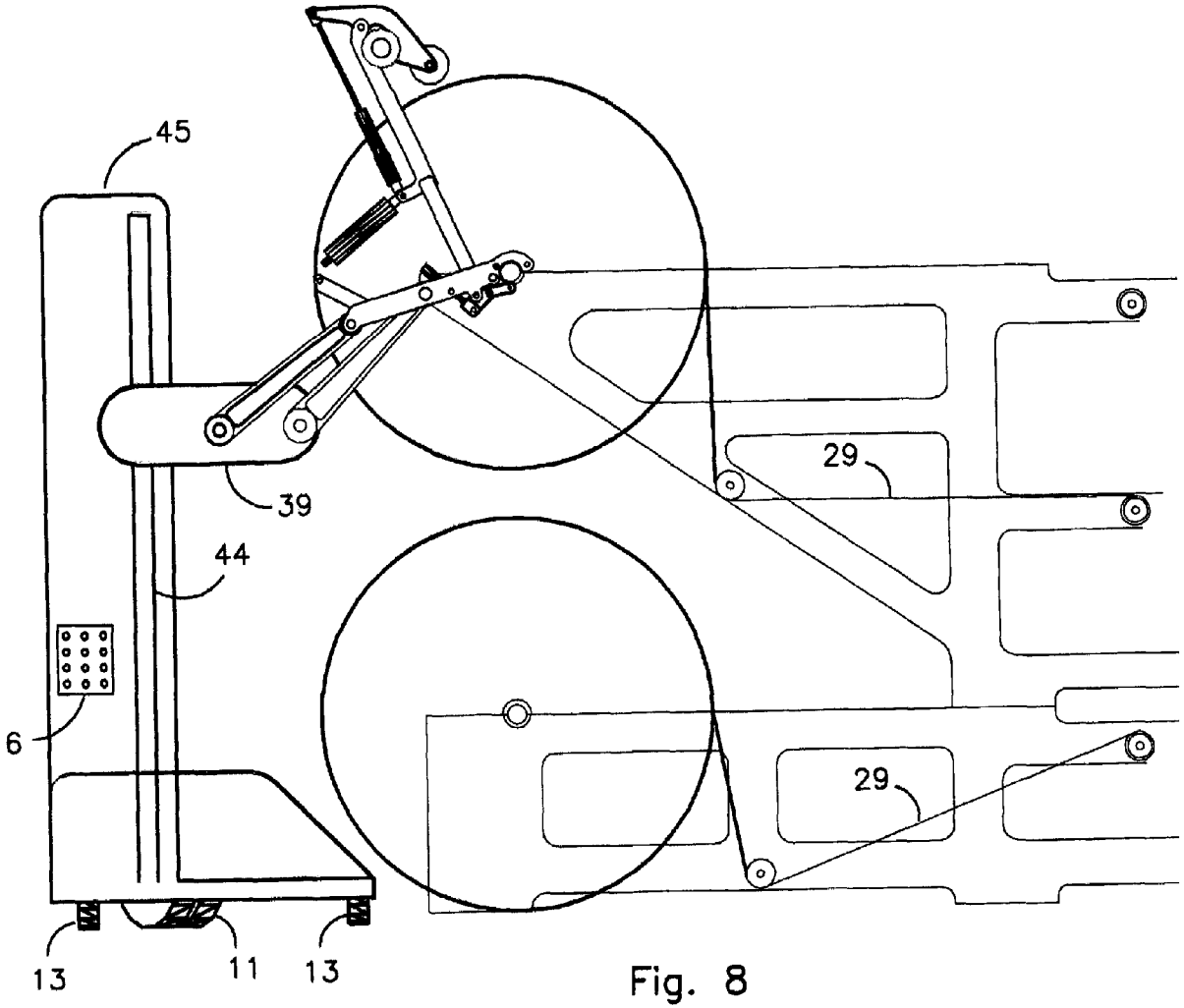
FIG. 8 is a pictorial view of the splicer vehicle adapted to load stacked rollstands.

FIG. 8 shows a two-high stacked rollstand being serviced by a modification of the basic design, wherein the lifting and splicing mechanism 39 is supported on an elevating track mechanism 44. A significant advantage of the present invention is that, after the new roll is loaded into the splicing vehicle, the splicing and core retrieval process requires no operator.

Figure 9:
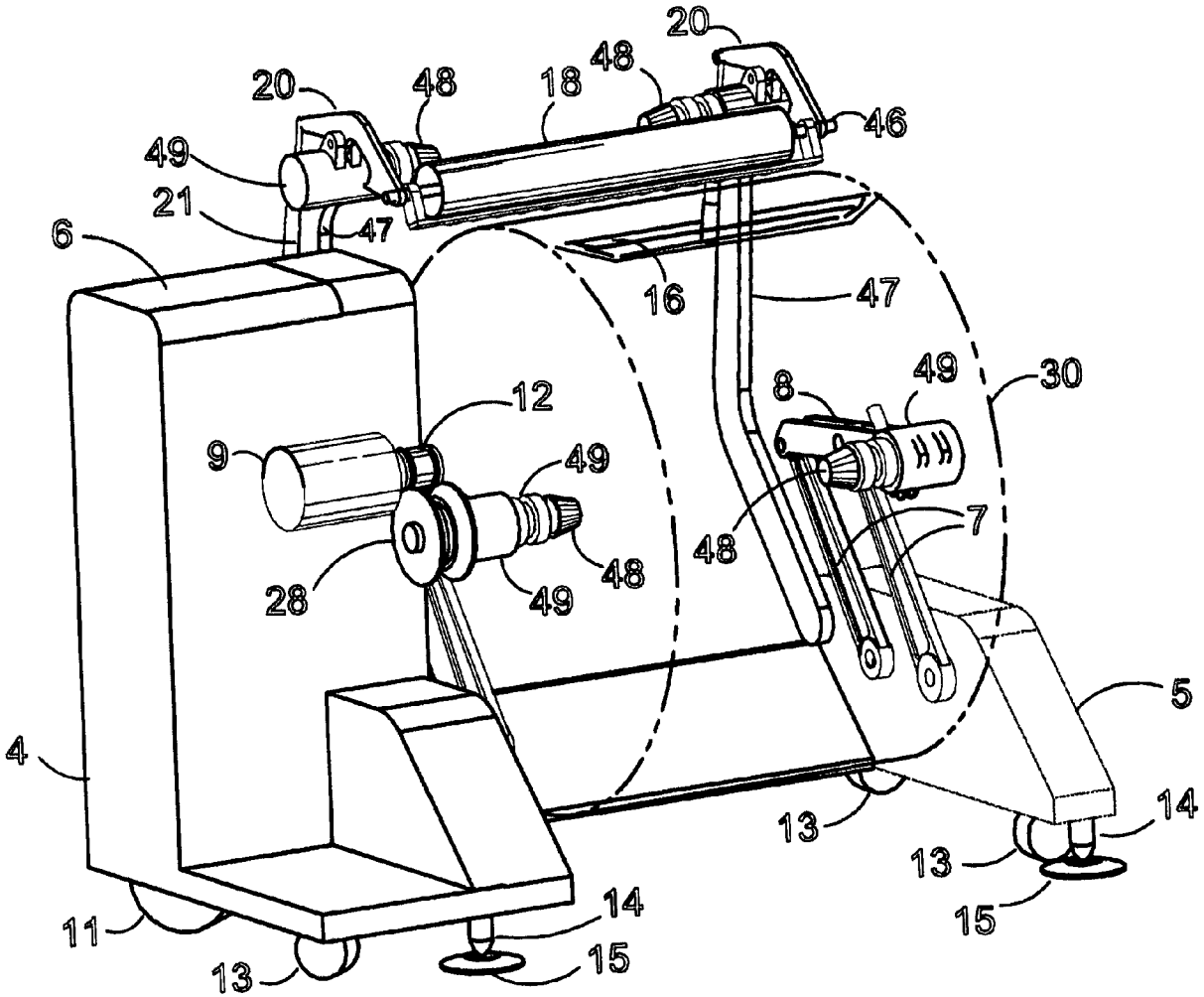
FIG. 9 is a pictorial view of the splicer vehicle adapted to function with core chucks, rather than a coreshaft. The splicer vehicle is shown conveying a new roll. The splicehead arms are raised and each shown engaging a core chuck.

Pictorial view FIG. 9 of the splicer vehicle, shows the splicer vehicle 4 conveying a new roll 30 having core chucks 48 inserted into each end of the roll core. Core chucks are commercially available of various designs. One type is the so-call self-actuating chuck which has a torque sensitive mechanism that expands the chuck inside the roll core responsive to a driving or braking torque. Other types of chucks are operated either mechanically or by pneumatics. In the present invention, the core chucks are being rotatably supported in roll lifting arms. The chuck arms 47 with chuck bearing housing 49 are shown raised, with each arm holding a core chuck for subsequent insertion into a new roll.

Figure 10:
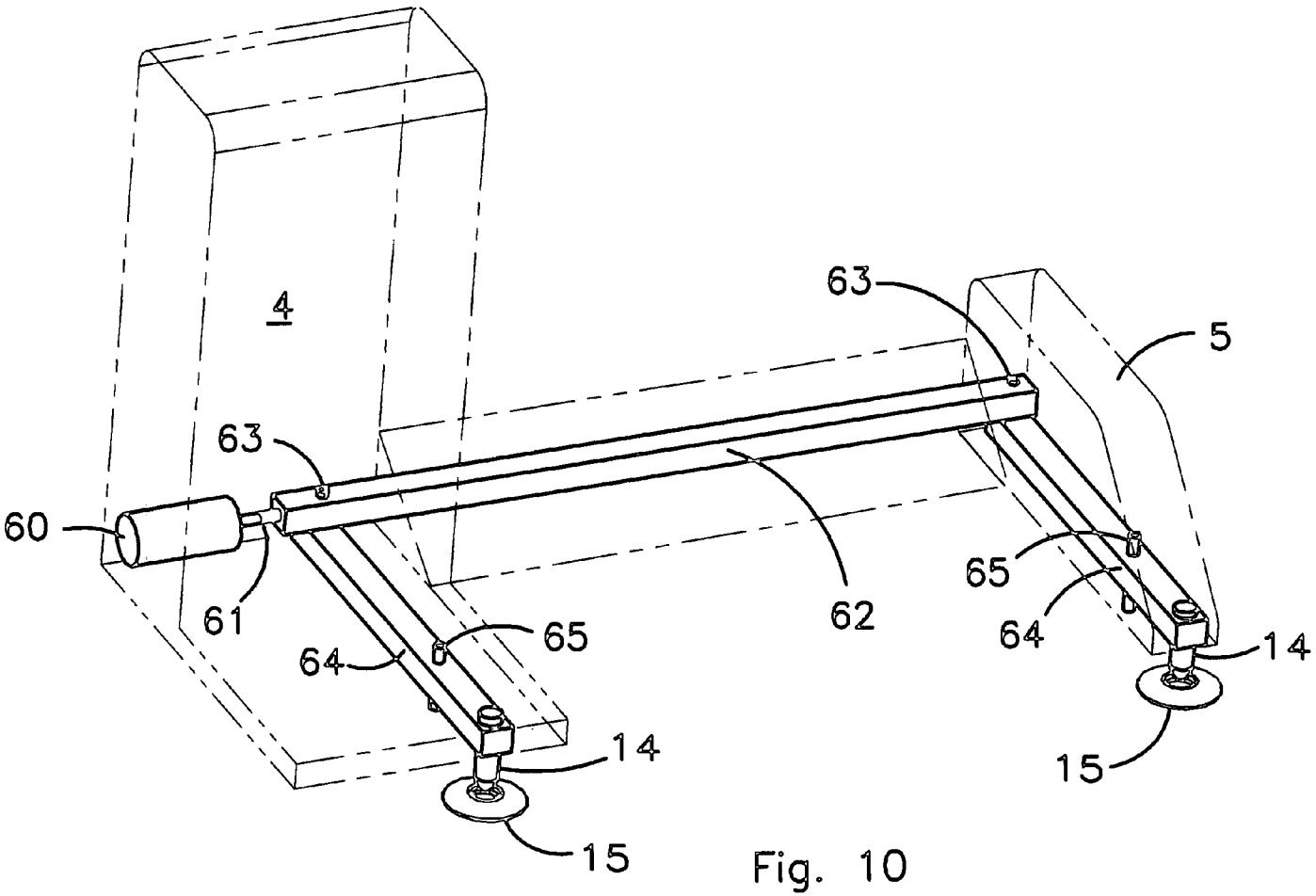
FIG. 10 is a pictorial showing the means of roll axial adjustment.

Pictorial view FIG. 10 shows automatic axial roll positioning means to align with the new roll to the dispensing roll. When splicehead support arms 17 (in FIG. 2), supporting edge sensor 59 are partially lowered, the face of the dispensing roll 23 (in FIG. 1) is detected. Servo-motor 60 then turns screw 61 which pulls link 62, causing pins 63 which engage arms 64 to rotate said arms about pivots 65, said arms also supporting tapered alignment pins 14. Said tapered alignment pins have been inserted into alignment disks 15 which are rigidly located in the floor and act as a fulcrum whereby the rotation of said arms 64 causes the splicing vehicle 4 & 5 to be repositioned along the axis of the new roll until sensor 59 detects the edge of roll 23.

The foregoing description of the preferred embodiment of the invention has been presented for purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

I claim:

1. A transport and splicing apparatus under the control of a computer, for supplying successively used rolls of web material to at least one web utilizing device from roll unwinding devices associated therewith, as an uninterrupted, continuously feeding web, by splicing said web from an at least partially depleted dispensing first roll of web material in said unwinding device, to a replacement second roll supplied by said transport and splicing apparatus consisting essentially of:

a first roll assembly including coreshaft means rigidly assembled into a central core of said first roll and a second roll assembly including coreshaft means rigidly assembled into a central core of said second roll, a roll transport vehicular means, supporting an operative roll positioning means for rotatably engaging and positioning said second roll assembly into a predefined spatial relation to said dispensing first roll of material, a driving means for operatively controlling the rotation of said second roll assembly, an operative splicing and web-severing means attached to said roll transport vehicular means by a pair of articulated arm means, operative arm means supported by said roll transport vehicular means, to engage and remove said first roll assembly from said unwind device, said operative roll positioning means thereafter moving said second roll assembly into the former position of said first roll assembly in said unwind device, thereby converting said replacement second roll into a dispensing first roll.

2. The apparatus in claim 1 wherein an operative roll positioning means attached to said roll transport vehicular means consisting essentially of:

a pair of gripper bars, each gripper bar supporting an operative coreshaft gripper, one gripper disposed at a first end of said coreshaft, and one gripper disposed at a second end of said coreshaft means, to engage and position said second roll assembly, while allowing said second roll assembly to rotate about its axis, where each of said gripper bars is operatively positioned by actuators and levers responsive to signals from said computer, the circumferential outer surface of said second roll assembly thereby being moved into proximal juxtaposition with said dispensing first roll, prior to the beginning of the splice cycle.

3. The apparatus as described in claim 1, wherein the driving means to control the rotation of said second roll consists of:

an electronic motor-drive means responsive to a speed-signal calculated by said computer primarily based on the arithmetic quotient of, the indicated web utilization velocity from a web velocity sensor, divided by the indicated diameter of said second roll from a sensor located on said transport and splicing apparatus, said motor drive means being provided with a rotary drive means coupled to said coreshaft to operatively control the rotation of said coreshaft, so disposed that said motor rotates said second roll at a surface velocity approximating the web utilization velocity during the time before the splice cycle, and during the time after the splice cycle, said motor-drive signal from said computer generally being a braking-torque signal based on the indicated web tension to the computer from a sensor preferably located in said web utilizing device, whereby the rotational velocity of said second roll regulates an essentially constant web tension during and after the splice cycle.

4. The apparatus as described in claim 1 wherein said splicing and web-severing means consists essentially of:

a pair of pivoted, spaced and parallel splicing arms, attached to said transporting and splicing apparatus, said apparatus also supporting operative actuators to position each of said splicing arms, each arm supporting an operatively pivoted bracket, said brackets supporting a first and second end of an operatively rotatable idler roller shaft, said roller shaft supporting on bearings a rotatable idler roller, said roller being so disposed as to redirect the path of web of said dispensing first roll of material during the splice cycle so that said dispensing web contacts the outer circumferential surface of said second roll to cause an adhesive area on the outer wrap to be forcibly contacted by said dispensing web, thereby forming a splice, and said roller shaft also having clamped rigidly thereto at each end, a pair of clamping blocks supporting a web severing means, said severing means being comprised of an elongated, serrated blade each end of which is rigidly attached to said blocks to operatively sever the spliced webs dispensing web simultaneously and in combination from said first and second rolls of material, from said first roll.

5. The apparatus as described in claim 1, wherein the roll transport vehicular means consists essentially of:

a pair of splicer arms adapted to support and position each end of said splicing and severing mechanism into parallel proximal juxtaposition to said second roll, and also to pivotably support and position a pair of splicing roller brackets, said brackets rotatively supporting a splicing roller, said splicing roller being adapted to redirect the path of the dispensing web, such that the web contacts said second roll, thereby forming a splice, and after the splice cycle is completed, said roller and said bracket assembly grasps said first roll and the coreshaft located therein, the pair of splicer arms thereafter being moved in a path such that said roller and bracket assembly in combination with said first roll supported thereby, are removed from aid unwind device.

6. The apparatus as described in claim 1, including computer operative means for automatically aligning the supporting mechanism of said first roll with said second roll such that the center-lines of said first roll and said second roll are parallel and the faces of both rolls are coplanar.

7. The apparatus as described in claim 1, including an elevating mechanism being provided to raise a carriage which supports:

said roll positioning means, said driving means for operatively controlling the rotation of said second roll assembly, said splicing and web-severing means, and said operative arm means to engage and remove said first roll assembly from said unwind device after the first roll has been spliced to the second roll, such that upper levels of a multilevel unwind device may be serviced by said apparatus.

8. The apparatus as described in claim 1 including signal broadcasting and receiving means attached to said vehicular means and the web utilizing device, to provide operational information including, web utilization speed, the diameters of the dispensing rolls, and emergency stops, and to automatically guide said vehicular means into a predetermined spatial relation to unwinding devices.

9. The apparatus as described in claim 1 wherein a sequence of rolls of material having a variety of characteristics may be successively supplied to a variety of web utilizing devices.

10. The apparatus as described in claim 1, wherein the coreshaft means is comprised of: a pair of selectively operative core chucks, internally engaging said rolls of material in the center of each end of said second roll, said chucks being selectively engaged and supported by a pair of spaced, parallel, and operatively pivoted chuck arms, said chuck arms being so disposed as to operatively place said chucks into the center of said second rolls, whereby said operative arm means may subsequently engage, lift and position said second rolls during the transport, splicing, and positioning of said second rolls into a pair of rotatable engagement means in said unwind device, so disposed at each end of said rolls as to rotatably engage said chucks, and after said first rolls are spliced, said chuck arms are so disposed as to engage and remove said first roll from said unwind device, said operative arm means thereafter moving said second roll into the former position of said first roll in said unwind device, thereby converting said replacement second roll into a dispensing first roll.

11. The apparatus as described in claim 1, wherein the roll transport vehicular means consists essentially of:

a pair of splicer arms supported by said transport and splicing apparatus adapted to support and position each end of said first roll assembly, said pair of splicer arms thereafter being moved in a path such that said first roll supported thereby is raised above the roll transport and splicing apparatus, said roll transport and splicing apparatus including said splicer arms then being moved to a location remote from the web utilizing device, said pair of splicer arms then being lowered to a convenient height for removal by an operator or automatic means, the core gripping means then being selectively operatively released, thereby discharging the coreshaft and expired roll assembly from said splicer arms.

12. A roll transport vehicular means consisting essentially of:

a transport vehicle including a frame structure, computer controls and sensors, operator controls, operative roll positioning means, operative roll rotation means, splicing and severing means, a roller, roller positioning means, and supporting wheels, acting in combination to transport a second roll of material from a storage location into a predefined spatial relation with a first dispensing roll in an unwind device, and adapted to perform a flying splice with said first roll, and to thereafter replace said first roll with said second roll.

* * * * *